US008616743B2

(12) United States Patent
Doring

(10) Patent No.: US 8,616,743 B2
(45) Date of Patent: Dec. 31, 2013

(54) PROJECTION MODULE FOR VEHICLES

(75) Inventor: Berthold Doring, Werl-Buderich (DE)

(73) Assignee: Hella KGaA Hueck & Co., Lippstadt (DE)

( * ) Notice: Subject to any disclaimer, the term of this patent is extended or adjusted under 35 U.S.C. 154(b) by 416 days.

(21) Appl. No.: 13/102,279

(22) Filed: May 6, 2011

(65) Prior Publication Data

US 2011/0273898 A1 Nov. 10, 2011

(30) Foreign Application Priority Data

May 7, 2010 (EP) ..... 10162280

(51) Int. Cl.
*F21V 17/00* (2006.01)

(52) U.S. Cl.
USPC ..... 362/546; 362/538; 362/539; 362/516; 362/433

(58) Field of Classification Search
USPC ..... 362/538, 539, 513, 546, 433
See application file for complete search history.

(56) References Cited

U.S. PATENT DOCUMENTS

| | | | | |
|---|---|---|---|---|
| 1,211,847 | A * | 1/1917 | Hough | 362/433 |
| 5,113,319 | A * | 5/1992 | Sekiguchi et al. | 362/466 |
| 6,086,231 | A * | 7/2000 | Kenjo et al. | 362/507 |
| 7,201,502 | B2 * | 4/2007 | Tsai | 362/513 |
| 7,520,649 | B2 * | 4/2009 | Sie | 362/539 |
| 2006/0239023 | A1 * | 10/2006 | Tsai | 362/539 |
| 2009/0251907 | A1 * | 10/2009 | Miller | 362/433 |
| 2009/0303741 | A1 * | 12/2009 | Shih | 362/539 |

FOREIGN PATENT DOCUMENTS

| | | | |
|---|---|---|---|
| DE | 4407108 | A1 | 1/1995 |
| DE | 19621254 | A1 | 11/1997 |
| DE | 202004020183 | U1 | 3/2005 |
| EP | 0355529 | A2 | 2/1990 |
| EP | 0590439 | A2 | 4/1994 |
| EP | 0936402 | A1 | 8/1999 |
| EP | 1547862 | A2 | 6/2005 |
| FR | 2767183 | A1 | 2/1999 |

* cited by examiner

*Primary Examiner* — David J Makiya
*Assistant Examiner* — Bryon T Gyllstrom
(74) *Attorney, Agent, or Firm* — Husch Blackwell LLP; Robert C. Haldiman

(57) ABSTRACT

Projection module for a light unit of a vehicle having a reflector, a light source assigned to the reflector, a shutter connected to the reflector in a detachable manner, a lens holder holding a lens and being detachably connected to the shutter, and a carrier frame detachably connected to the reflector for the connection to a housing of the light unit, wherein the carrier frame is connected to the lens holder to form an integrally formed basic carrier part having, on a side facing the reflector, positioning means for the positioning of the shutter and screw fastening means for the screwable connection with a front edge of the reflector.

12 Claims, 2 Drawing Sheets

PROJECTION MODULE FOR VEHICLES

CROSS-REFERENCE TO RELATED APPLICATIONS

The present application claims priority to and incorporates herein by reference European Patent Application Serial No. 10 162 280.1 filed on May 7, 2010.

DESCRIPTION

Projection module for a light unit of a vehicle having a reflector, a light source assigned to the reflector, a shutter connected to the reflector in a detachable manner, a lens holder holding a lens and being detachably connected to the shutter, and a carrier frame detachably connected to the reflector for the connection to a housing of the light unit.

From EP 1 547 862 A2, a projection module for a light unit for a vehicle is known, which works according to the projection principle and which comprises, in addition to a light source and a reflector, a shutter and a lens. The light source is arranged in a first focal point of the ellipsoid reflector and the shutter is arranged in a second focal point of the reflector, wherein an edge of the shutter is projected onto the road as the cut-off line. The lens is held by means of a lens holder which is connected to the reflector using a bayonet coupling. The shutter is screwed onto the reflector. For the connection of the light unit to a housing, the reflector is connected to a carrier frame. As a relatively large number of component parts has to be connected, the problem is to ensure a relatively accurate alignment of the component parts relative to one another at a reasonable price.

It is therefore an object of the invention to further develop a projection module for a light unit of a vehicle in a manner that ensures the fast and safe assembly of the projection module with simple means, and herein particularly an accurate positioning.

For the solution of this problem, the invention in connection with the preamble of the patent claim 1 is characterized in that the carrier frame is connected to the lens holder to form an integrally formed basic carrier part having, on a side facing the reflector, positioning means for the positioning of the shutter and screw fastening means for the screwable connection with a front edge of the reflector.

The particular advantage of the present invention is that a significant reduction of cost and effort relating to the assembly can be achieved by means of the development of a basic carrier part. The basic carrier part unites the functions of the carrier frame and the lens holder and by providing positioning means and screw fastening means, it allows in addition that a reflector and a shutter are held in a specified, centered position. Therefore, the basic carrier part represents essentially the only non optical/photometric element of the projection module in addition to the photometric component parts "light source", "reflector", "shutter" and "lens".

According to a preferred embodiment of the invention the screw fastening means of the basic carrier part are formed so that the basic carrier part can be connected with the front edge of the reflector by means of a bayonet coupling. This can advantageously lead to a simple locking and/or axial fixing of the reflector to the basic carrier part.

According to a preferred embodiment of the invention a leading circumferential flange of the reflector can be fixed on the basic carrier part by means of tabs which can be bent around a rotational axis running at right angles relative to the optical axis of the reflector. This fixing is executed after the actuation of the bayonet coupling in the locked position of the reflector and allows the accurate centering and positioning of the reflector relative to the shutter and the basic carrier part.

According to a further development of the invention, at least two tabs are provided, which are each bendable around one of two rotational axes running at an acute angle or an obtuse angle or at right angles relative to one another.

According to a further development of the invention the tab is attached to the flange of the reflector while forming two radial cuts in said flange. By bending the tabs in the locked position of the reflector and therefore engaging behind the recesses on the edge of the shutter, safe locking and centering can be ensured.

According to a further development of the invention, the clamping contacting of the tab on the shutter ensures an electroconductive connection between the reflector and the shutter, which improves the shielding effect in case a light source in the shape of a gas discharge lamp with connected ballast is used.

Further advantages of the invention are shown in the other sub-claims.

In the following, one exemplary embodiment of the invention is explained in details by means of the drawings.

BRIEF DESCRIPTION OF THE DRAWINGS

Herein.

DETAILED DESCRIPTION OF INVENTION

Figure 1:
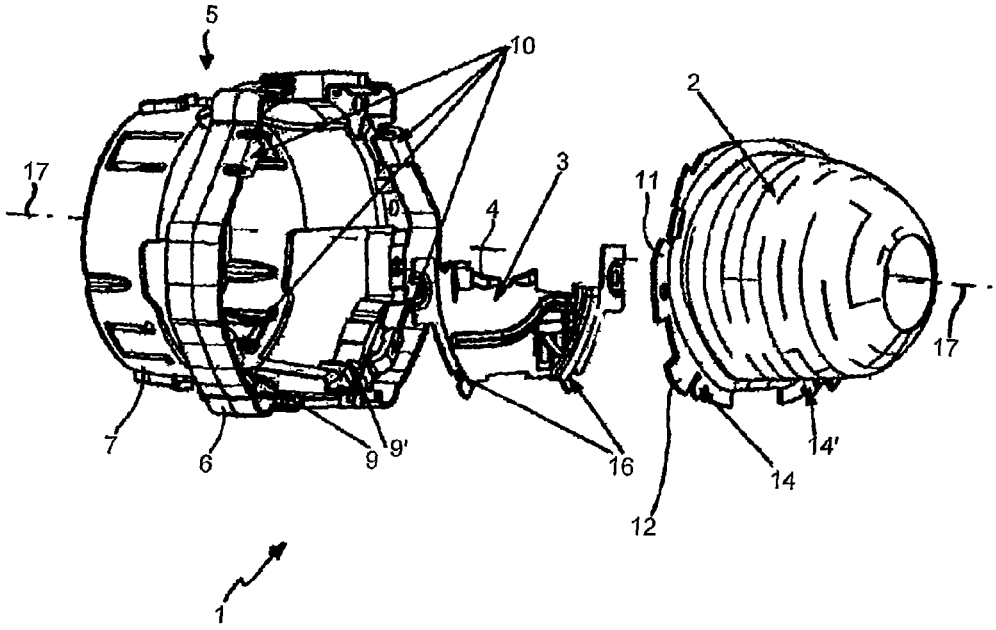
FIG. 1 shows an exploded view of a projection module according to the invention with a basic carrier part, a shutter and a reflector.

A light unit for vehicles is preferably arranged integrated in a headlamp of a motor vehicle. The light unit can for example serve for the generation of a low beam and/or high beam light distribution or for another light distribution. The light unit is fastened to a housing of the headlamp and comprises essentially a projection module 1 working according to the projection principle, To this end, the projection module 1 comprises essentially an unembodied light source, a reflector 2 assigned to the light source, a shutter 3 as well an unembodied lens. Preferably, the reflector 2 has an elliptic shape. The light source is arranged in a first focal point of the reflector 2. The shutter 3 with a shutter edge 4, by means of which the cut-off line of the light distribution can be projected on the road surface, is arranged in the region of a second focal point of the reflector 2.

According to the invention, a basic carrier part 5 is provided, which on one hand serves as a carrier frame for the connection of the projection module 1 to the housing of the headlamp and which, on the other hand serves as the lens holder for the reception of the lens. The basic carrier part 5 is formed integrally and can for example consist of plastic material. The basic carrier part 5 has a tubular shape and has a first ring section 6 facing the reflector and having a diameter which is larger than a second ring section 7 directly following on the side facing away from the reflector.

The second ring section 7 essentially comprises holding means for the reception and positionally safe fastening of the lens.

The first ring section 6 comprises bores 8 distributed in the circumferential direction for the screw connection of the projection module 1 with the housing of the light unit.

Furthermore, the first ring section 6 comprises positioning means 9 for the positioning of the shutter 3 on the basic carrier part 5. As positioning means positioning pockets 9' and/or positioning webs may for example be provided, by means of which the shutter 3 can be fastened to the first ring section 6 of the basic carrier part 5.

Figure 2:
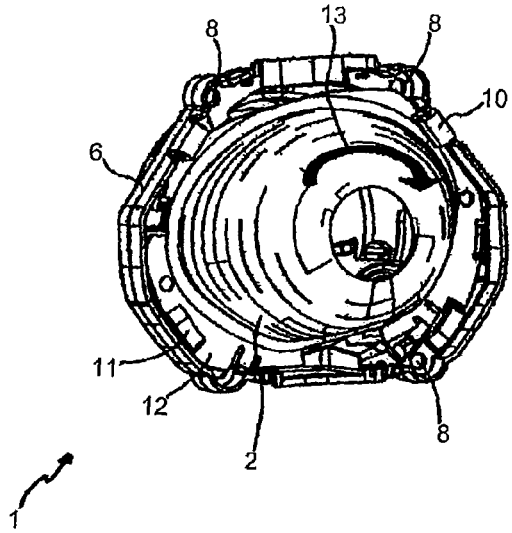
FIG. 2 shows a rear view of the projection module in the unlocked position of the reflector.
Figure 4:
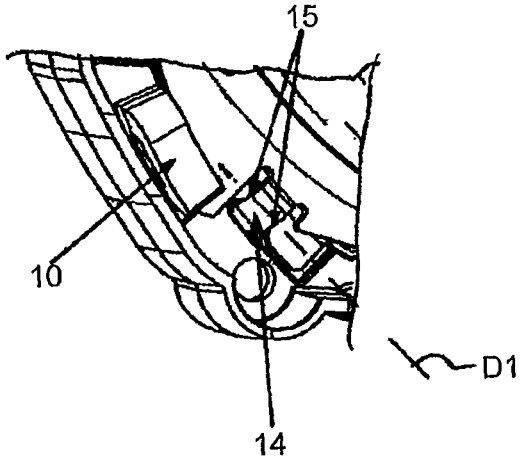
FIG. 4 is an enlarged view of a fastening point of the reflector on the basic carrier part.

The first ring section 6 comprises screw fastening means 10, so that the reflector 2 can be locked to the basic carrier part 5 with a screw connection by its circumventing flange 11 arranged at its front edge. In a locked position of the reflector 2 one radial holding lug 12 each of the reflector flange 11 engages behind beaded holding elements arranged on the circumference and serving as screw fastening means 10. The screw fastening means is embodied as a bayonet coupling allowing fast and safe assembly. As can be seen in FIG. 2, in the unlocked position, the holding lug 12 is still arranged next to the holding element 10 of the basic carrier part 5. By rotating the reflector 2 in the direction of arrow 13 the holding lug 12 is rotated in the direction of the holding element 10, so that it engages behind the latter, see particularly FIG. 4.

For the safe centering of the reflector 2 relative to the shutter 3 and the basic carrier part 5, the reflector flange 11 has, in addition, two tabs 14, 14' running essentially at right angles relative to one another. The tabs 14, 14' are each formed by radial cuts 15 of a given length on the reflector flange 11. Once the reflector 2 has been moved from the unlocked position according to FIG. 2 into the locked position according to FIG. 3, the tabs 14, 14' are in a position in which they can be bent and/or moved in the light radiation direction and engage around the recesses 16 on the edge of the shutter 3.

Figure 3:
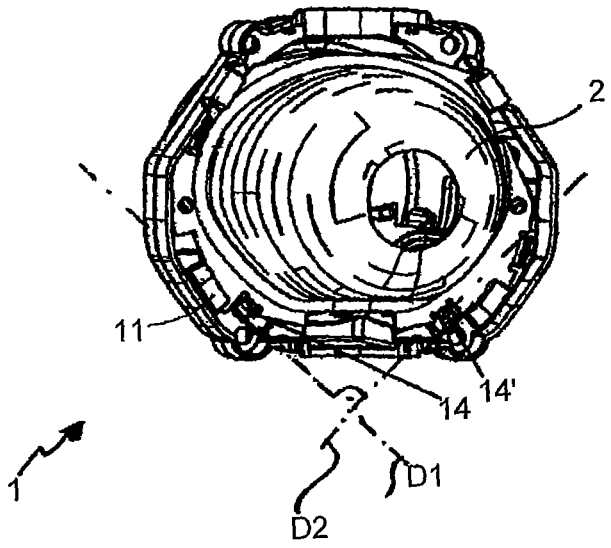
FIG. 3 shows a rear view of the projection module in the locked position of the reflector.

As can be seen in FIG. 3, the rotational axis D1 of the first tab 14 runs at right angles to the rotational axis D2, around which the second tab 14' can be bent. Alternatively, the rotational axes D1 and D2 can also run at an acute angle or an obtuse angle relative to one another. The provision of at least two tabs 14, 14' ensures an accurate and safe centering of the photometrically relevant component parts of the projection module 1. The rotational axes D1 and D2 run essentially tangential to the reflector flange 11 on one hand and at right angles to an optical axis 17 of the reflector 2 on the other hand.

The clamped fastening of the tabs 14, 14' on the shutter 3 ensures a safe electroconductive connection between the reflector 2 and the shutter 3, both made from metallic material. When using a gas discharge lamp with a ballast as a light source, improved EMC-shielding can be achieved.

LIST OF REFERENCE SYMBOLS

1 projection module
2 reflector
3 shutter
4 shutter edge
5 basic carrier part
6 first ring section
7 second ring section
8 bores
9, 9' positioning means/pockets/webs
10 screw fastening means/holding means
11 flange
12 holding lug
13 direction of arrow
14, 14' tab
15 radial cut
16 recess
17 optical axis
D1, D2 rotational axis

What is claimed is:

1. A projection module for a light unit of a vehicle comprising:
- a reflector;
- a light source assigned to the reflector;
- a shutter connected to the reflector in a detachable manner;
- a lens holder holding a lens and being detachably connected to the shutter;
- a carrier frame detachably connected to the reflector for connection to a housing of the light unit;
- the carrier frame being connected with the lens holder to form an integrally formed basic carrier part having, on a side facing the reflector, a coupler and a shutter seat;
- said shutter having a recess;
- said reflector having a coupling lug and a positioning tab;
- said coupler being dimensioned and disposed to retain the reflector upon rotational engagement with said lug;
- said rotational engagement positioning said positioning tab over said recess such that said positioning tab is bendable into said recess;
- whereby said shutter is retained in a preconfigured correct position.

2. The projection module of claim 1, wherein said coupler comprises a bayonet coupling, said bayonet coupling holding the front edge of the reflector to the carrier frame.

3. The projection module of claim 1, characterized in that the front edge of the reflector is formed as a circumferential flange with a number of radial holding lugs which, in a locking position, each engage behind the coupler of the carrier frame.

4. The projection module of claim 1, characterized in that a flange of the reflector can be fixed on the carrier frame with a bendable tab bendable on a rotational axis running at right angles with regard to an optical axis of the reflector.

5. The projection module of claim 1, having at least two tabs each of said tabs being bendable around one of two rotational axes running at substantially right angles relative to one another.

6. The projection module of claim 1, having at least two tabs each of said tabs being bendable around one of two bending axes each, running at an acute angle, an obstuse angle or at right angles.

7. The projection module of claim 1, characterized in that the tab is arranged on a flange of the reflector and shaped so that it can be bent around a rotational axis which is tangential relative to the flange.

8. The projection module of claim 1, characterized in that the tab is bent on a recess on the edge of the shutter in a locked position, wherein the tab engages behind the recess on an edge.

9. The projection module of claim 1, characterized in that the reflector is connected to the shutter in an electroconductive manner by the tab.

10. The projection module of claim 1, characterized in that the carrier frame has a tubular shape with a first ring section facing the reflector and with a second ring section receiving the lens and having a diameter smaller than that of the first ring section.

11. The projection module of claim 10, characterized in that the first ring section of the carrier frame has a number of bores for screw fastening to the housing of the light unit.

12. The projection module of claim 1 further comprising said carrier frame having a receiving recess, said receiving recess being in registry with said recess when in a locked position, said receiving recess providing a space into which said tab may be bent.

* * * * *